US010185262B2

(12) United States Patent
Matsuno

(10) Patent No.: US 10,185,262 B2
(45) Date of Patent: Jan. 22, 2019

(54) FIXING DEVICE HAVING PRESSING MEMBER AND GEAR ARRANGEMENT

(71) Applicant: Brother Kogyo Kabushiki Kaisha, Nagoya-shi, Aichi-ken (JP)

(72) Inventor: Takuji Matsuno, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/868,512

(22) Filed: Jan. 11, 2018

(65) Prior Publication Data

US 2018/0203391 A1 Jul. 19, 2018

(30) Foreign Application Priority Data

Jan. 18, 2017 (JP) ..... 2017-006510

(51) Int. Cl.
*G03G 15/20* (2006.01)

(52) U.S. Cl.
CPC ..... *G03G 15/206* (2013.01); *G03G 15/2064* (2013.01); *G03G 2215/2019* (2013.01)

(58) Field of Classification Search
CPC ..... G03G 15/2089; G03G 15/2064; G03G 15/206; G03G 2215/2019; G03G 2215/2035
USPC ..... 399/328, 331; 219/216
See application file for complete search history.

(56) References Cited

U.S. PATENT DOCUMENTS

| | | | | |
|---|---|---|---|---|
| 5,835,835 | A | 11/1998 | Nishikawa et al. | |
| 2005/0117942 | A1* | 6/2005 | Ishii | G03G 15/2064 399/328 |
| 2012/0155938 | A1* | 6/2012 | Tanaka | G03G 15/2075 399/335 |
| 2013/0011160 | A1* | 1/2013 | Kanai | G03G 15/2017 399/122 |
| 2014/0169848 | A1* | 6/2014 | Tanaka | G03G 15/2057 399/331 |
| 2015/0286176 | A1* | 10/2015 | Shibata | G03G 15/2017 399/329 |

FOREIGN PATENT DOCUMENTS

| | | | |
|---|---|---|---|
| JP | H10-048994 | A | 2/1998 |
| JP | H11-249481 | A | 9/1999 |
| JP | 2011-095306 | A | 5/2011 |
| JP | 2014-109596 | A | 6/2014 |

* cited by examiner

*Primary Examiner* — Robert Beatty
(74) *Attorney, Agent, or Firm* — Banner & Witcoff, Ltd.

(57) ABSTRACT

A fixing device includes a fixing roller, a pressure member, a heating device, a first pressing member, a second pressing member, and a pair of bearings. The pressure member is configured to nip a recording medium in cooperation with the fixing roller. The heating device is disposed opposite to the pressure member relative to the fixing roller. The first pressing member is configured to press the pressure member toward the fixing roller with a first pressing force. The second pressing member is configured to press the heating device toward the fixing roller with a second pressing force. The fixing roller includes a driven gear to be driven by a drive gear that is configured to apply a third pressing force to the driven gear. The third pressing force includes a component opposite in direction to a resultant force of the first pressing force and the second pressing force.

13 Claims, 7 Drawing Sheets

FIXING DEVICE HAVING PRESSING MEMBER AND GEAR ARRANGEMENT

CROSS-REFERENCE TO RELATED APPLICATION

This application claims priority from Japanese Patent Application No. 2017-006510 filed on Jan. 18, 2017, the content of which is incorporated herein by reference in its entirety.

TECHNICAL FIELD

Aspects of the disclosure relate to a fixing device for an image forming apparatus.

BACKGROUND

A known fixing device includes a heating member, a fixing roller, and a backup member. The fixing roller contacts the heating member to form a heating nip portion therebetween. The backup member contacts the fixing roller to form a fixing nip portion therebetween. In the fixing device, the fixing roller is disposed between the heating member and the backup member.

SUMMARY

In the known fixing device, the fixing roller is disposed between the heating member and the backup member (e.g., a pressing member) and the fixing roller is pressed by both of the heating member and the backup member. Therefore, a resultant force of a pressing force of the heating member and a pressing force of the pressing member acts on bearings of the fixing roller.

Accordingly, some embodiments of the disclosure provide for a configuration that may reduce a load acting on bearings of a fixing roller.

According to one or more aspects of the disclosure, a fixing device for thermally fixing a developer image transferred to a recording medium thereon, includes a fixing roller, a pressure member, a heating device, a first pressing member, a second pressing member, and a pair of bearings. The pressure member contacts a portion of the fixing roller and configured to nip the recording medium in cooperation with the fixing roller. The heating device is disposed opposite to the pressure member relative to the fixing roller. The heating device contacts another portion of the fixing roller. The heating device is configured to heat the fixing roller. The first pressing member is configured to press the pressure member toward the fixing roller with a first pressing force. The second pressing member is configured to press the fixing roller toward the heating device with a second pressing force. The pair of bearings supports end portions of the fixing roller such that the fixing roller is rotatable.

The fixing roller includes a driven gear to be driven by a drive gear that is configured to apply a third pressing force to the driven gear. The third pressing force includes a component opposite in direction to a resultant force of the first pressing force and the second pressing force.

According to the one or more aspects of the disclosure, the third pressing force includes the component opposite to the resultant force of the first pressing force and the second pressing force. Therefore, a load acting on the bearings of the fixing roller may be reduced.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Figure 1:
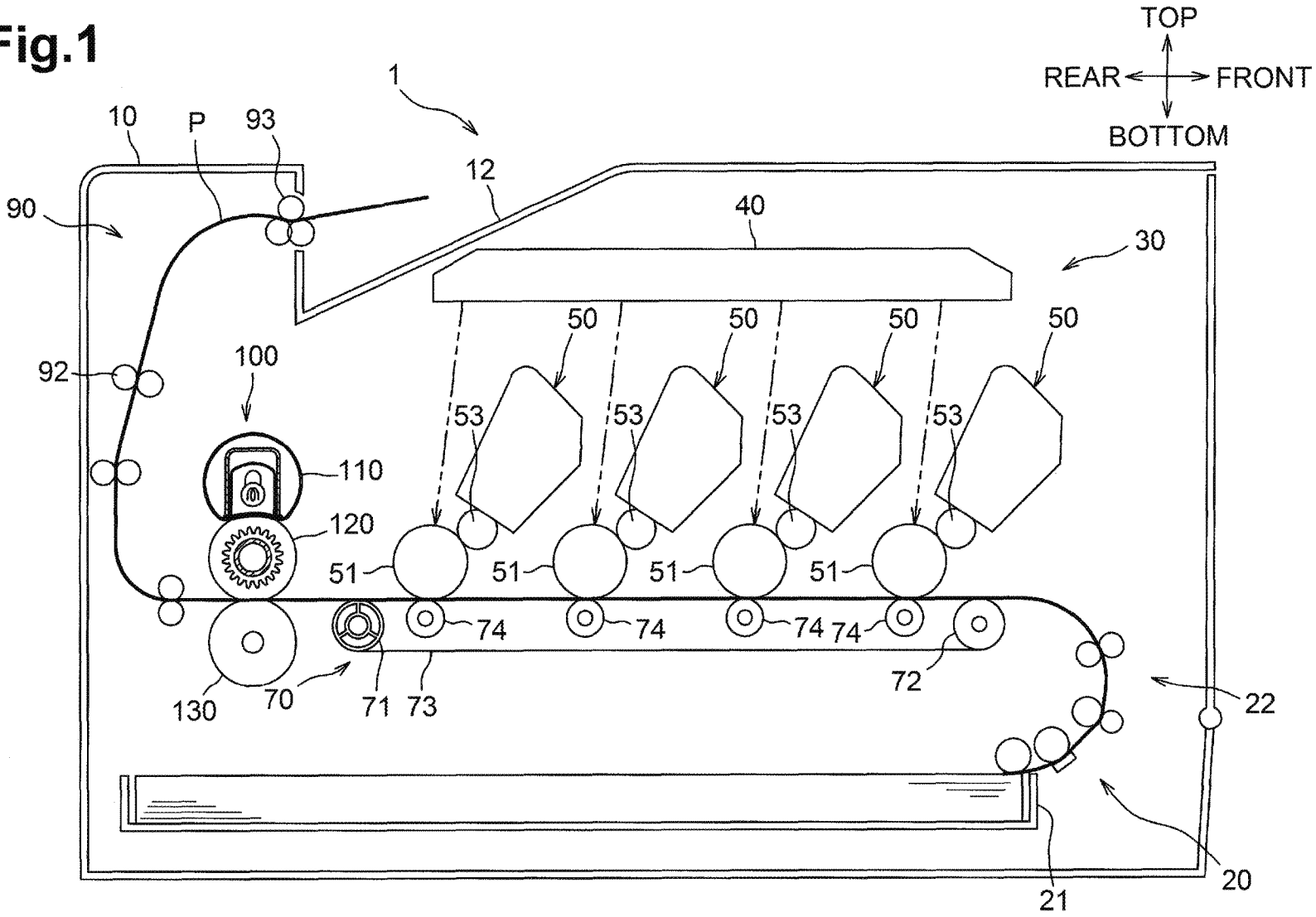
FIG. 1 is a schematic cross sectional view of an image forming apparatus in an illustrative embodiment according to one or more aspects of the disclosure.

Illustrative embodiments will be described with reference to the accompanying drawings, like reference numerals being used for like corresponding parts in the various drawings. An overall configuration of a color printer 1 (an example of an image forming apparatus) will be described and then one or more features of the disclosure will be described in detail.

Hereinafter, description will be made with reference to directions, top, bottom, front, and rear, as defined in FIG. 1. The right and left of the color printer 1 are defined as viewed from the front of the color printer 1.

As illustrated in FIG. 1, the color printer 1 includes a housing 10. The color printer 1 further includes a feed unit 20, an image forming unit 30, and a discharge unit 90 in the housing 10. The feed unit 20 is configured to feed a recording medium, e.g., a sheet P. The image forming unit 30 is configured to form an image onto a fed sheet P.

The feed unit 20 includes a feed tray 21 and a sheet conveyor 22. The feed tray 21 is configured to accommodate one or more sheets P therein. The sheet conveyor 22 is configured to feed, one by one, sheets P from the feed tray 21 and convey the fed sheet P to the image forming unit 30.

The image forming unit 30 includes a scanner 40, a plurality of, four, process cartridges 50, a transfer unit 70, and a fixing device 100.

The scanner 40 is disposed in an upper portion of the housing 10, and includes light emitters, a polygon mirror, lenses, and reflectors. The scanner 40 is configured to emit a laser beam from each of the light emitters to a circumferential surface of a corresponding photosensitive drum 51. The laser beam scans the circumferential surface of the corresponding photosensitive drum 51 at a high scanning speed.

The process cartridges 50 are disposed in tandem in a front-rear direction and above the feed unit 20. Each of the process cartridges 50 includes a photosensitive drum 51, a developing roller 53, a charger (not illustrated), and a toner chamber.

The transfer unit 70 is disposed between the feed unit 20 and the plurality of process cartridges 50 in a top-bottom direction. The transfer unit 70 includes a drive roller 71, a driven roller 72, a conveying belt 73, and transfer rollers 74.

The drive roller 71 and the driven roller 72 extend parallel to each other while being spaced apart from each other in the front-rear direction. The conveying belt 73, e.g., an endless belt, is looped around the drive roller 71 and the driven roller 72. The transfer rollers 74 (e.g., four transfer rollers 74) are disposed inside a loop of the conveying belt 73 while being opposite to the respective photosensitive drums 51 relative to the conveying belt 73. Each pair of photosensitive drum 51 and transfer roller 74 holds the conveying belt 73 therebetween.

The fixing device 100 is disposed further to the rear than the rearmost process cartridge 50 and the transfer unit 70. The fixing device 100 includes a heating device 110, a fixing roller 120, and a pressure roller 130 (an example of a pressure member).

In the image forming unit 30, in each of the process cartridges 50, the charger uniformly charges the circumferential surface of the rotating photosensitive drum 51. The scanner 40 then emits a laser beam onto the circumferential surface of each of the photosensitive drums 51. Thus, the circumferential surface of each of the photosensitive drums 51 are exposed to the laser beam and an electrostatic latent image based on image data is formed thereon.

Then, the developing roller 53 supplies toner (e.g., developer) onto the electrostatic latent image formed on the circumferential surface of the photosensitive drum 51 to form a developer image thereon. Thereafter, the sheet conveyor 22 conveys a sheet P fed from the feed tray 21 of the feed unit 20 to between each pair of photosensitive drum 51 and transfer roller 74 to transfer the developing image onto the fed sheet P from the circumferential surface of each of the photosensitive drums 51. Subsequently, the fixing device 100 thermally fixes the developer images to the sheet P.

The discharge unit 90 includes conveying rollers 92 and discharge rollers 93. The discharge unit 90 is configured to discharge a sheet P, which has passed the image forming unit 30, to the outside of the housing 10. A sheet P is discharged to the outside of the housing 10 by the conveying rollers 92 and the discharge rollers 93 and is placed on a discharge tray 12 defined at the top of the housing 10.

Figure 2:
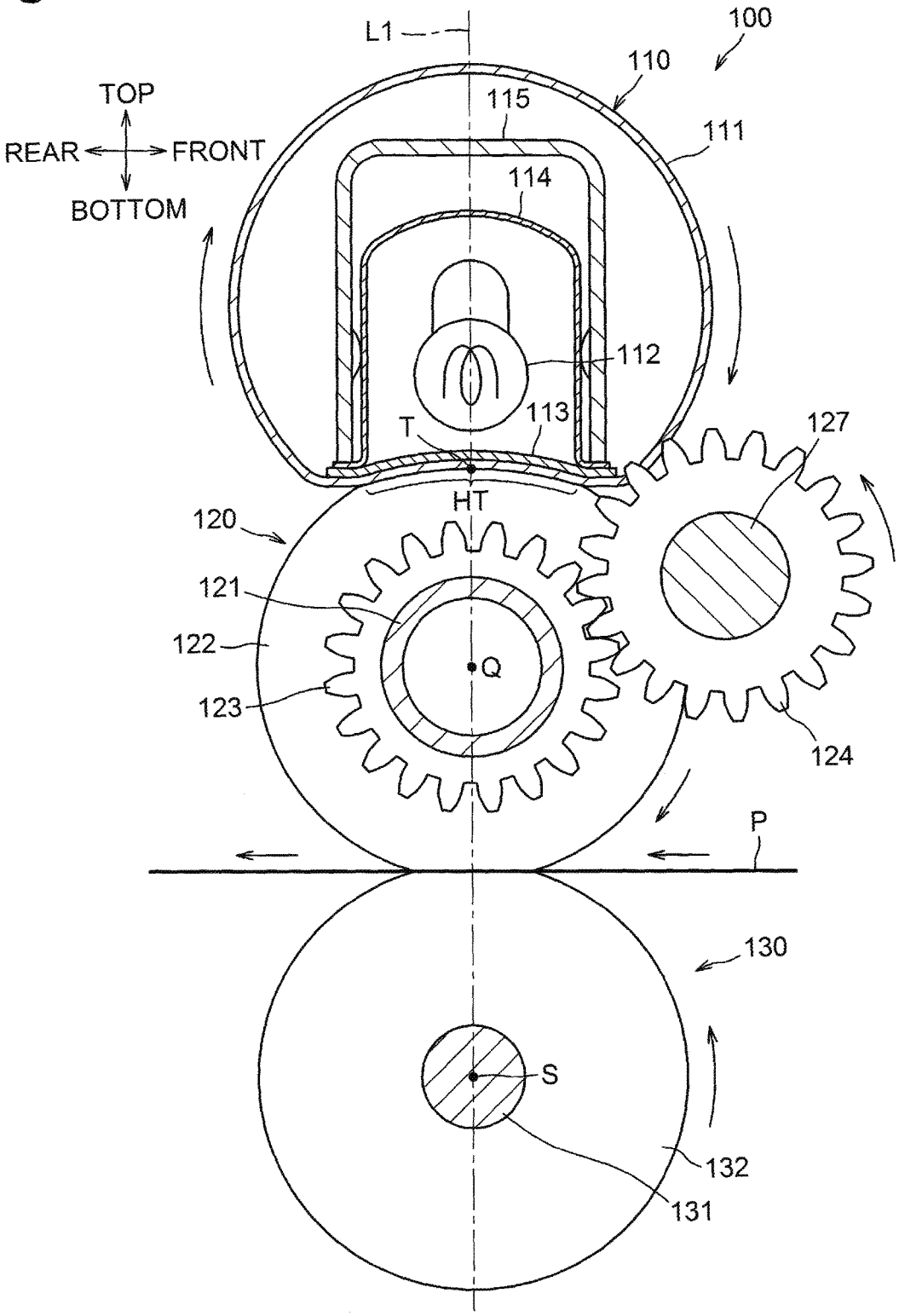
FIG. 2 is a cross sectional view of a fixing device of the image forming apparatus in the illustrative embodiment according to one or more aspects of the disclosure.

As illustrated in FIG. 2, the heating device 110 is configured to heat the fixing roller 120 by contacting the fixing roller 120. The heating device 110 is opposite to the pressure roller 130 relative to the fixing roller 120. The heating device 110 includes an endless belt 111 (an example of a belt), a halogen lamp 112 (an example of a heater), a nip plate 112 (an example of a nip member), a reflector 114, and a stay 115.

The endless belt 111 has heat resistance and flexibility, and is partially sandwiched between the nip plate 113 and the fixing roller 120. The endless belt 111 is rotatable in such a state. A portion of an outer circumferential surface of the endless belt 111 contacts a portion of a circumferential surface of the fixing roller 120 to define a heat transfer portion HT therebetween.

The halogen lamp 112 is a heater for heating the nip plate 113 and the endless belt 111. The halogen lamp 112 is spaced apart from the nip plate 113 by a predetermined gap.

The nip plate 113 is an elongated member with its longer sides extending in the right-left direction. The nip plate 113 has a surface that is slidable relative to an inner circumferential surface of the endless belt 111 when the endless belt 111 rotates. The nip plate 113 is configured to transfer heat radiated from the halogen lamp 112, to the fixing roller 120, via the endless belt 111. The nip plate 113 may be made of metal, for example, aluminum.

The reflector 114 is configured to reflect heat radiated from the halogen lamp 112 toward the nip plate 113. The reflector 114 covers the halogen lamp 112 while being spaced apart from the halogen lamp 112 by a predetermined gap. Collecting radiant heat from the halogen lamp 112 using the reflector 114 may enable speedy heating of the nip plate 113 and the endless belt 111.

The stay 115 provides stiffness to the nip plate 113 by supporting front and rear end portions of the nip plate 113 via the reflector 114. The stay 115 has a U shape in cross section and covers the halogen lamp 112 and the reflector 114.

The fixing roller 120 is disposed below the heating device 110. The fixing roller 120 includes a shaft 121, a roller body 122, and a driven gear 123 (an example of a driven gear). The shaft 121 may be a hollow cylindrical metal rod. The roller body 122 may include an elastic layer covering a circumferential surface of the shaft 121.

The driven gear 123 is fixed to a left end portion of the shaft 121 of the fixing roller 120 and is therefore coaxial with the shaft 121 of the fixing roller 120. The driven gear 123 meshes with a drive gear 124 (an example of a drive gear). The drive gear 124 is disposed further toward the front than the driven gear 123 (e.g., upstream from the driven gear 123 in a sheet conveyance direction), and a portion of the drive gear 124 is located above an entirety of the driven gear 123 in the top-bottom direction. The drive gear 124 is configured to receive a driving force transmitted from a motor (not illustrated) to rotate counterclockwise in FIG. 2, e.g., in a direction that a portion of the drive gear 124 meshing with the driven gear 123 moves toward the pressure roller 130.

The pressure roller 130 is disposed below the fixing roller 120, and is configured to nip a sheet P in cooperation with the fixing roller 120. The pressure roller 130 includes a shaft 131 and a roller body 132. The shaft 131 may be a sold cylindrical metal rod. The roller body 132 may include an elastic layer covering a circumferential surface of the shaft 131. A circumferential surface of the roller body 132 is contactable to a sheet P. The shaft 131 of the pressure roller 130 has a diameter smaller than the shaft 121 of the fixing roller 120. Material used for the elastic layer of the roller body 132 of the pressure roller 130 is softer than material used for the elastic layer of the roller body 122 of the fixing roller 120. Further, the elastic layer of the roller body 132 of the pressure roller 130 has a greater thickness than the elastic layer of the roller body 122 of the fixing roller 120.

The heating device 110, the fixing roller 120, and the pressure roller 130 are disposed one above another. More specifically, for example, the heating device 110, the fixing roller 120, and the pressure roller 130 are disposed one above another such that a middle point T of the heat transfer portion HT is located on a line L1 that perpendicularly intersects each of an axis Q of the fixing roller 120 and an axis S of the pressure roller 130. The heat transfer portion HT has a middle point T in a rotating direction of the fixing roller 120.

Figure 3:
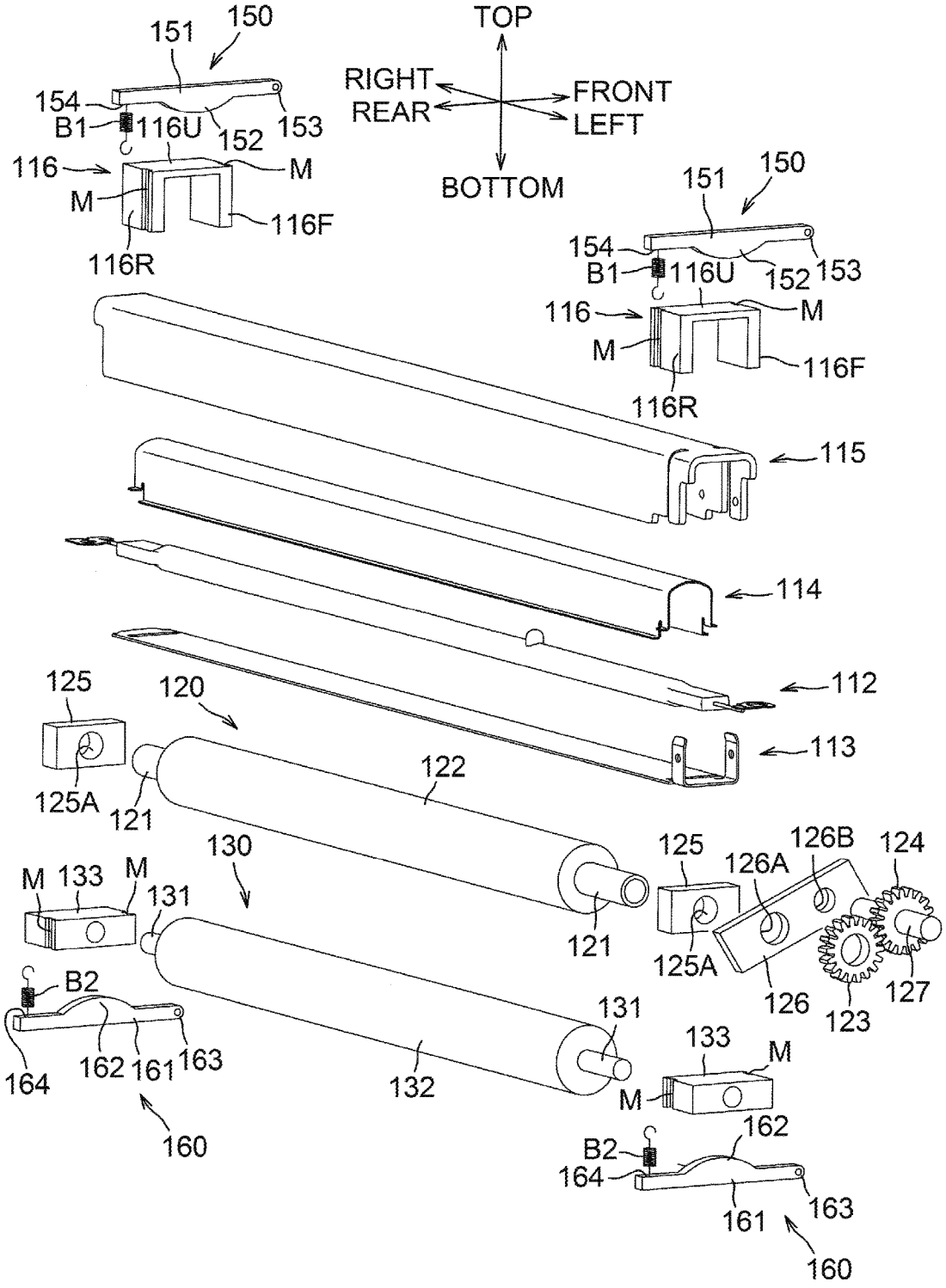
FIG. 3 is an exploded perspective view of the fixing device in the illustrative embodiment according to one or more aspects of the disclosure.

As illustrated in FIG. 3, the heating device 110 further includes a pair of stay covers 116. The stay covers 116 hold right and left end portions, respectively, of the stay 115. Each of the stay covers 116 has a substantially U-shape for covering a corresponding end portion of the stay 115 from above. Each of the stay covers 116 includes an upper portion 116U, a front portion 116F, and a rear portion 116R. The front portion 116F extends downward from a front end of the upper portion 116U. The rear portion 116R extends downward from a rear end of the upper portion 116U. The front portion 116F and the rear portion 116R each have a groove M in their outer surfaces. The grooves M extend in the top-bottom direction.

A first bearing 125 is disposed at each end portion of the fixing roller 120. The first bearings 125 (an example of a pair of bearings) support an outer circumferential surface of the shaft 121 of the fixing roller 120 such that the fixing roller 120 is rotatable. A gear plate 126 is disposed to the left of the left first bearing 125.

The first bearings 125 support the respective end portions of the shaft 121 such that the shaft 121 is rotatable. More specifically, for example, each of the first bearings 125 has a bearing hole 125A penetrating therethrough in the right-left direction. The bearing holes 125A of the first bearings 125 support the respective end portions of the shaft 121 such that the shaft 121 is rotatable.

The gear plate 126 may be a metal plate member. The gear plate 126 defines a distance between an axis (i.e., the axis Q) of the driven gear 123 and an axis (i.e., an axis R) of the drive gear 124 and holds the driven gear 123 and the drive gear 124. The gear plate 126 has bearing holes 126A and 126B penetrating therethrough in the right-left direction. The bearing hole 126A supports the left end portion of the shaft 121 of the fixing roller 120 to which the driven gear 123 is fixed. The bearing hole 126B supports the shaft 127 to which the drive gear 124 is fixed.

The pressure roller 130 is rotatably supported at its end portions by second bearings 133. The second bearings 133 each have a groove M in their front and rear outer surfaces. The grooves M extend in the top-bottom direction.

Figure 4:
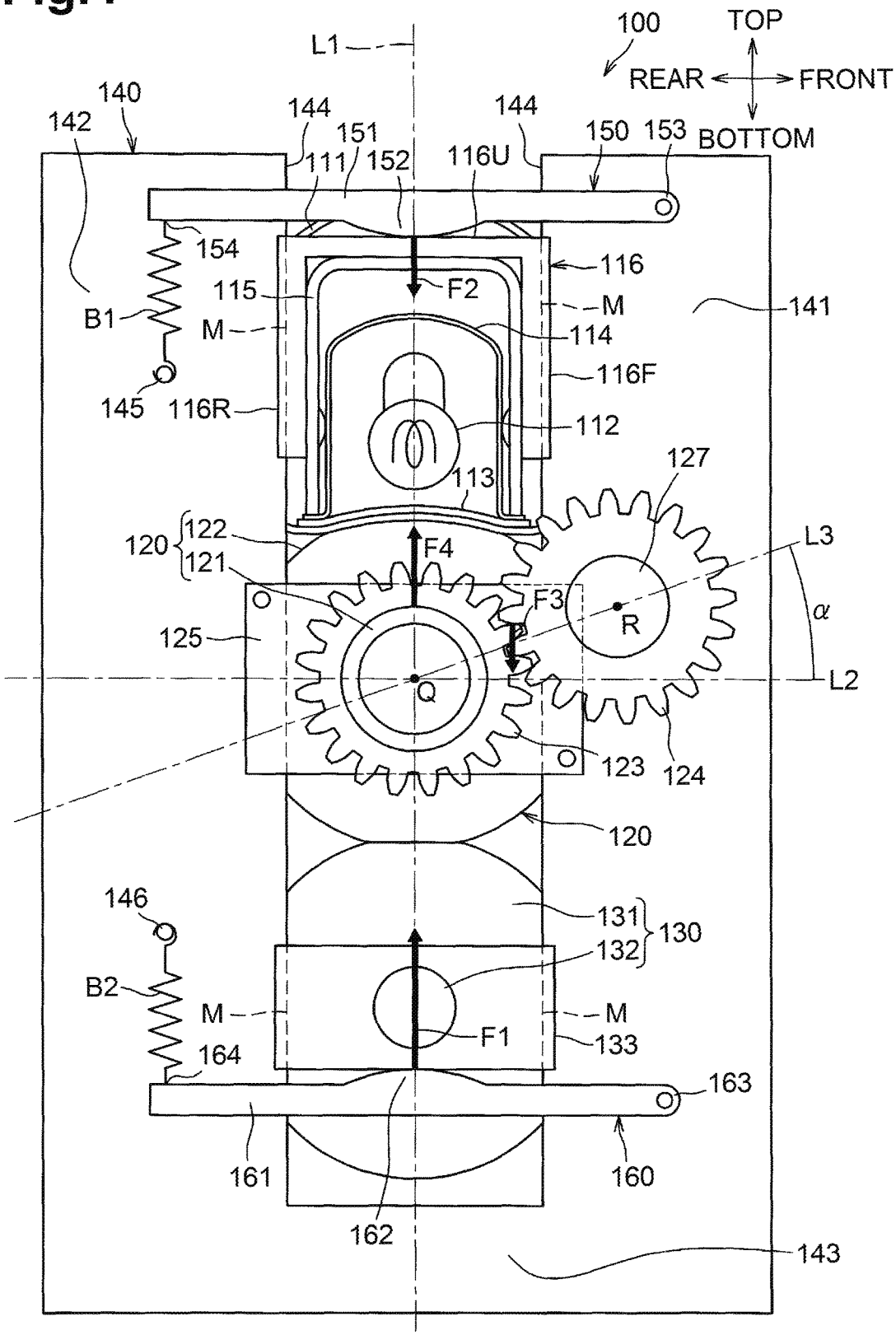
FIG. 4 is a left side view of the fixing device in the illustrative embodiment according to one or more aspects of the disclosure.
Figure 5:
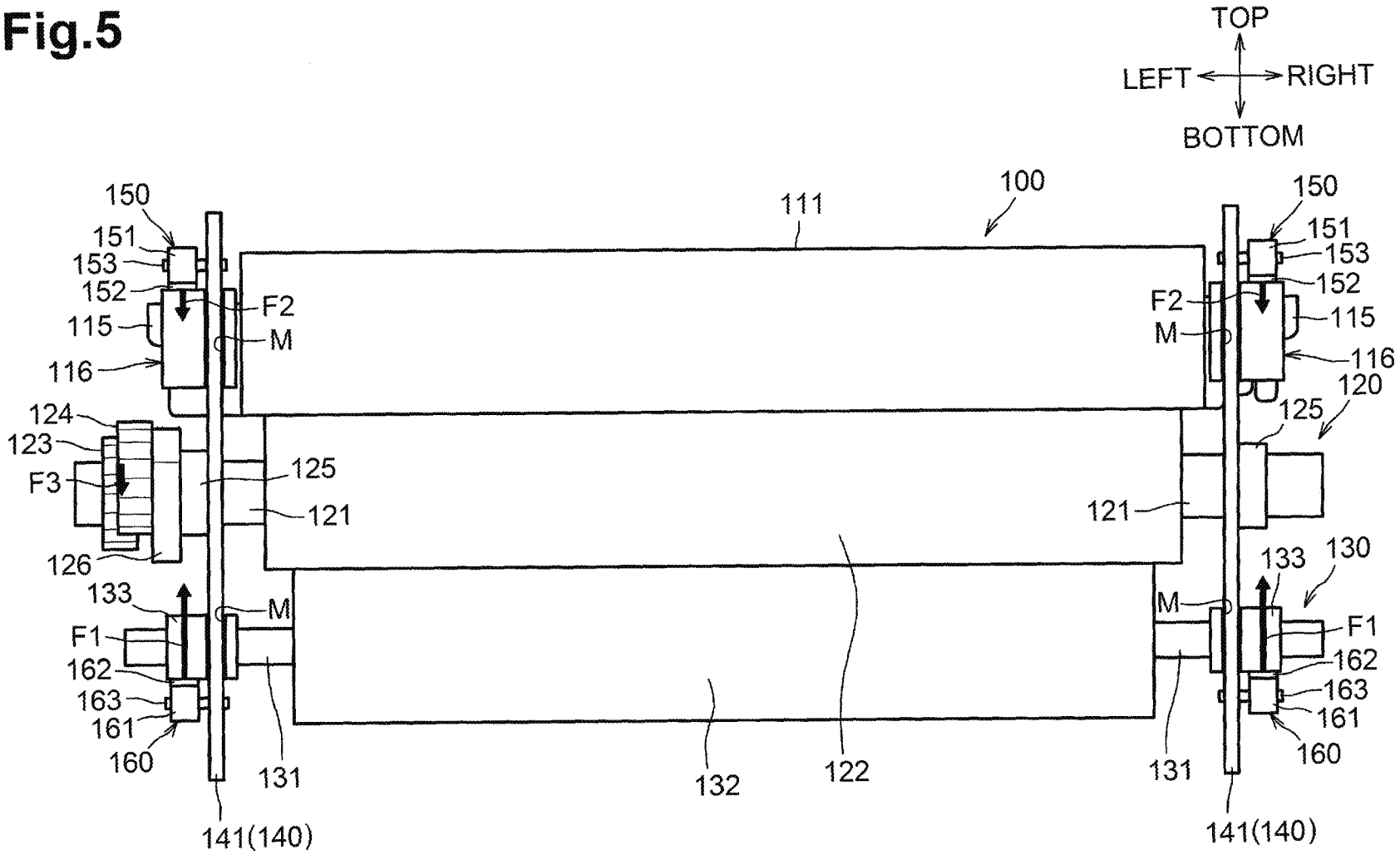
FIG. 5 is a front view of the fixing device in the illustrative embodiment according to one or more aspects of the disclosure.

As illustrated in FIGS. 4 and 5, the fixing device 100 further includes side frames 140, upper arms 150 (each of which is an example of a second pressing member), and lower arms 160 (each of which is an example of a first pressing member). The upper arms 150 press the heating device 110 toward the fixing roller 120. The lower arms 160 press the pressure roller 130 toward the fixing roller 120.

The right side frame 140 is disposed further to the right than the heating device 110, the fixing roller 120, and the pressure roller 130. The left side frame 140 is disposed further to the left than the heating device 110, the fixing roller 120, and the pressure roller 130. Each of the side frames 140 may have a plate shape. Each of the side frames 140 includes a front wall 141, a rear wall 142, and a connecting portion 143 that connects between a lower end of the front wall 141 and a lower end of the rear wall 142. The front wall 141 is spaced apart from the rear wall 142, and the front wall 141 and the rear wall 142 define a guide groove 144 therebetween. The guide groove 144 extends linearly in the top-bottom direction.

The first bearings 125 are fixed to the respective side frames 140 such that each of the first bearings 125 extends between the front wall 141 and the rear wall 142. With this configuration, the fixing roller 120 is rotatably supported by the side frames 140 at the fixed position.

In each of the side frames 140, the stay cover 116 is located in the guide groove 144 while the stay cover 116 is engaged with the front wall 141 and the rear wall 142 via the grooves M. With this configuration, the stay cover 116 is supported by the side frame 140 so as to be slidable in the top-bottom direction relative to the side frame 140. The second bearing 133 is also located in the guide groove 144 while the second bearing 133 is engaged with the front wall 141 and the rear wall 142 via the grooves M. With this configuration, the second bearing 133 is supported by the side frame 140 so as to be slidable in the top-bottom direction relative to the side frame 140.

The right upper arm 150 is disposed further to the right than the right side frame 140, and the left upper arm 150 is disposed further to the left than the left side frame 140. The upper arms 150 are disposed above the respective stay covers 116 and are positioned correspondingly to the respective end portions of the heating device 110. The upper arms 150 press the respective stay covers 116. Each of the upper arms 150 extends in the front-rear direction and includes an arm body 151 and a protruding portion 152 protruding downward from a middle portion of the arm body 151.

The protruding portion 152 has a curved surface that curves downward in the middle. A front end portion 153 of the arm body 151 is supported by the front wall 141 of the side frame 140 such that the upper arm 150 is pivotable. The arm body 151 includes a spring engagement portion 154 at its rear end portion. The spring engagement portion 154 is engaged with one end (e.g., an upper end) of a first tension spring B1. The other end (e.g., a lower end) of the first tension spring B1 is engaged with a spring engagement portion 145 disposed at a corresponding side frame 140.

The upper arm 150 is pulled by the first tension spring B1 constantly. Thus, the upper arm 150 presses the heating device 110 toward the fixing roller 120 with a second pressing force F2 constantly. Therefore, each of the right and left upper arms 150 presses a corresponding one of the stay covers 116 with the second pressing force F2 constantly.

The right lower arm 160 is disposed further to the right than the right side frame 140 and the left lower arm 160 is disposed further to the left than the left side frame 140. The lower arms 16 are disposed below the respective second bearings 133 and are positioned correspondingly to the respective end portions of the pressing roller 130. The lower arms 160 press the respective second bearings 133. Each of the lower arms 160 extends in the front-rear direction and includes an arm body 161 and a protruding portion 162 protruding upward from a middle portion of the arm body 161.

The protruding portion 162 has a curved surface that curves upward in the middle. A front end portion 163 of the arm body 161 is supported by the front wall 141 of the side frame 140 such that the lower arm 160 is pivotable. The arm body 161 includes a spring engagement portion 164 at its rear end portion. The spring engagement portion 164 is engaged with one end (e.g., a lower end) of a second tension spring B2. The other end (e.g., an upper end) of the second tension spring B2 is engaged with a spring engagement portion 146 disposed at a corresponding side frame 140.

The lower arm 160 is pulled by the second tension spring B2 constantly. Thus, the lower arm 160 presses the pressing roller 130 toward the fixing roller 120 with a first pressing force F1 constantly. Therefore, each of the right and left lower arms 160 presses a corresponding one of the second bearings 133 with the first pressing force F1 constantly.

The first pressing force F1 is directed upward and parallel to the line L1. The second pressing force F2 is directed downward and parallel to the line L1. The first pressing force F1 has a greater magnitude than the second pressing force F2. Therefore, a resultant force F4 of the first pressing force F1 and the second pressing force F2 is directed upward and parallel to the line L1.

As illustrated in FIG. 4, an angle α has the same degrees as a pressure angle between the driven gear 123 and the drive gear 124. The angle α is formed between a line L3, which intersects each of the axis Q of the driven gear 123 and the axis R of the drive gear 124, and a line L2, which perpendicularly intersects each of the line L1 and the axis Q of the fixing roller 120. For example, in a case where the pressure angle between the driven gear 123 and the drive gear 124 is 20 degrees, the angle α is also 20 degrees. Therefore, a third pressing force F3 that is to be applied to the driven gear 123 from the drive gear 124 when the drive gear 124 rotates is directed downward and parallel to the line L1. The third pressing force F3 is directed opposite to the resultant force F4 of the first pressing force F1 and the second pressing force F2. The first pressing force F1 has a greater magnitude than a resultant force of the second pressing force F2 and the third pressing force F3.

According to the fixing device 100 of the illustrative embodiment, the following effects may be achieved.

In the illustrative embodiment, the first tension springs B1 pull the respective upper arms 150 downward. Therefore, the upper arms 150 are urged downward and the protruding portions 152 of the upper arms 150 press the upper portions 116U of the respective stay covers 116 downward. With this configuration, the heating device 110 presses the fixing roller 120 with the second pressing force F2. On the other hand, the second tension springs B2 pull the lower arms 160 upward. Therefore, the lower arms 160 are urged upward and the protruding portions 162 of the lower arms 160 press the respective second bearings 133 upward. With this configuration, the pressure roller 130 presses the fixing roller 120 with the first pressing force F1.

Under such a situation, the resultant force F4 of the first pressing force F1 and the second pressing force F2 is directed upward. Therefore, a load that is the resultant force F4 acts on an upper-half portion of an inner surface of the bearing hole 125A in each of the first bearings 125 supporting the shaft 121 of the fixing roller 120.

When the drive gear 124 rotates counterclockwise in FIG. 4, the drive gear 123 rotates clockwise in FIG. 4 by the rotation of the drive gear 124. When the driven gear 123 is rotated by the drive gear 124, the driven gear 123 receives the third pressing force F3 that acts in a pressure angle direction, e.g., downward.

The third pressing force F3 is directed 180 degrees opposite to the resultant force F4 of the first pressing force F1 and the second pressing force F2. Therefore, when a driving force is inputted to the drive gear 124, some of the resultant force F4 acting on the upper-half portion of the inner surface of the bearing holes 125A may be cancelled by the third pressing force F3 effectively. Accordingly, the load (e.g., the resultant force F4) that acts on the upper surfaces of the bearing holes 125A of the first bearings 125 may be reduced.

The first pressing force F1 has a greater magnitude than the second pressing force F2. Therefore, the fixing device 100 may be enabled to have a relatively large nip pressure. Further, the second pressing force F2 has a relatively small magnitude. Therefore, the endless belt 111 may have higher slidability relative to the nip plate 113.

The first pressing force F1 has a greater magnitude than the resultant force of the second pressing force F2 and the third pressing force F3. Therefore, in both cases whether or not the fixing roller 120 is being applied with a driving force from the drive gear 124, the fixing roller 120 receives a greater force from the pressure roller 130 side than the heading device 110 side. Accordingly, in the both cases, the shaft 121 of the fixing roller 120 is pressed upward against the first bearings 125, and a direction that the load acting on the first bearings 125 does not change significantly between those cases.

The heating device 110, the fixing roller 120, and the pressure roller 130 are disposed one above another such that the middle point T of the heat transfer portion HT is located on the line L1 that perpendicularly intersects each of the axis Q of the fixing roller 120 and the axis S of the pressure roller 130. Therefore, the pressing forces that the heating device 110, the fixing roller 120, and the pressure roller 130 press one another are all directed parallel to the line L1. Accordingly, the resultant force F4 of the first pressing force F1 and the second pressing force F2 acting on the first bearings 125 may be reduced.

The lower arms 160 are positioned corresponding to the respective end portions of the pressing roller 130 and press the respective end portions of the pressing roller 130 with an equal pressing force (e.g., the first pressing force F1). Therefore, the pressure roller 130 applies an equal pressing force to the right and left portions of the fixing roller 120, thereby nipping a sheet P stably in cooperation with the fixing roller 120. The upper arms 150 are positioned corresponding to the respective end portions of the heating device 110 and press the respective end portions of the heating device 110 with an equal pressing force (e.g., the second pressing force F2). Therefore, the heating device 110 contacts the fixing roller 120 with applying an equal pressing force to right and left end portions of the fixing roller 120, thereby heating an entire portion of the fixing roller 120 uniformly.

The shaft 121 of the fixing roller 120 may be a hollow cylindrical metal rod. Therefore, the shaft 120 has a relatively low heat capacity and does not tend to release heat. Since heat accumulated in the shaft 120 does not tend to escape from the shaft 120, the fixing roller 120 may transfer heat effectively from the heating device 110 to a nip portion between the fixing roller 120 and the pressure roller 130. Further, since the roller body 122 of the fixing roller 120 includes an elastic layer, the fixing roller 120 may transfer heat effectively from the heating device 110 to the nip portion between the fixing roller 120 and the pressure roller 130.

The drive gear 124 and the driven gear 123 are held by the gear plate 126 that defines the distance between the axis Q of the driven gear 123 and the axis R of the drive gear 124. Therefore, the distance between the axis Q of the driven gear 123 and the axis R of the drive gear 124 is maintained constantly, thereby ensuring stable rotation of the driven gear 123 and the drive gear 124.

The material used for the elastic layer of the roller body 132 of the pressure roller 130 is softer than the material used for the elastic layer of the roller body 122 of the fixing roller 120. Further, the elastic layer of the roller body 132 of the pressure roller 130 has a greater thickness than the elastic layer of the roller body 122 of the fixing roller 120. This configuration may therefore enable the nip portion defined between the fixing roller 120 and the pressure roller 130 to have a relatively wide width in the sheet conveyance direction. Further, since the material used for the elastic layer of the roller body 122 of the fixing roller 120 is harder than the material used for the elastic layer of the roller body 132 of the pressure roller 130, the fixing roller 120 and the pressure roller 130 may convey a sheet P stably.

While the disclosure has been described in detail with reference to the specific embodiment thereof, this is merely an example, and various changes, arrangements and modifications may be applied therein without departing from the spirit and scope of the disclosure. In the following alternative embodiments, an explanation will be given mainly for the parts different from the illustrative embodiment, and an explanation will be omitted for the common components by assigning the same reference numerals thereto.

In the illustrative embodiment, as illustrated in FIG. 4, the first pressing force F1 has a greater magnitude than the second pressing force F2. Nevertheless, in other embodiments, for example, the first pressing force F1 may have a smaller magnitude than the second pressing force F2.

Figure 6:
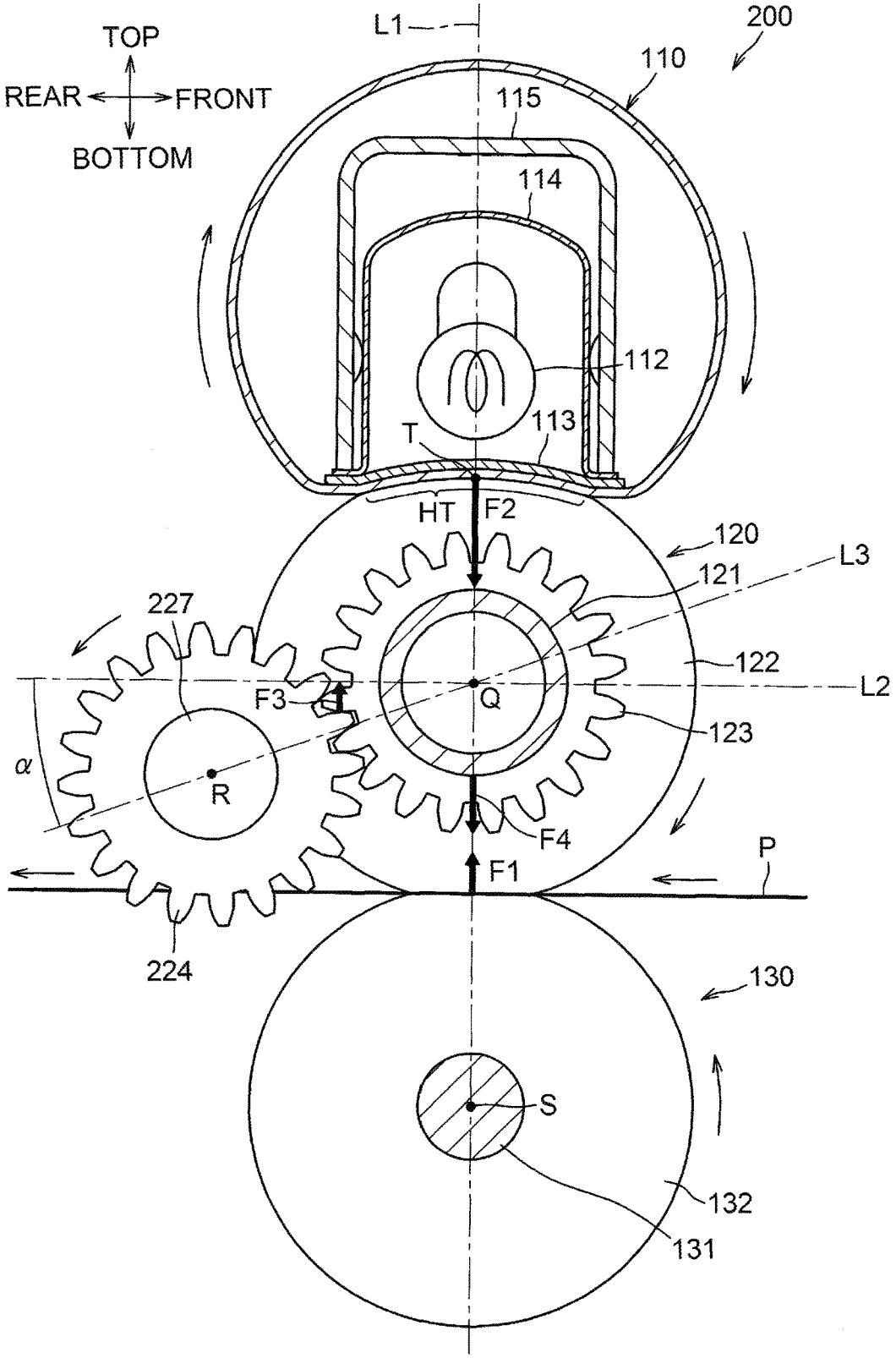
FIG. 6 is a cross sectional view of a fixing device in an alternative embodiment according to one or more aspects of the disclosure.

In an alternative embodiment, as illustrated in FIG. 6, for example, a fixing device 200 includes a drive gear 224 instead of the drive gear 124. The drive gear 224 is disposed further to the rear than the driven gear 123 (e.g., downstream from the driven gear 123 in the sheet conveyance direction), and a portion of the drive gear 224 is located below an entirety of the driven gear 123. An angle α has the same degrees as a pressure angle between the driven gear 123 and the drive gear 224. The angle α is formed between a line L3, which intersects each of the axis Q of the driven gear 123 and an axis R of the drive gear 224, and the line L2. The first pressing force F1 has a smaller magnitude than the second pressing force F2.

In the fixing device 200, a resultant force F4 of the first pressing force F1 and the second pressing force F2 is directed downward and parallel to the line L1. Therefore, a load that is the resultant force F4 acts on a lower surface of the bearing hole 125A in each of the first bearings 125 supporting the shaft 121 of the fixing roller 120. The third pressing force F3 that is to be applied to the driven gear 123 from the drive gear 224 when the drive gear 224 rotates is directed upward and parallel to the line L1. That is, the third pressing force F3 includes a component opposite in direction to the resultant force F4 of the first pressing force F1 and the second pressing force F2. Therefore, in the fixing device 200, also, when a driving force is inputted to the drive gear 224, the load acting on the lower surface of the bearing holes 125A may be reduced.

In the illustrative embodiment (refer to FIG. 4) and the alternative embodiment (refer to FIG. 6), the heating device 110, the fixing roller 120, and the pressure roller 130 are disposed one above another such that the middle point T of the heat transfer portion HT is located on the line L1 that perpendicularly intersects each of the axis Q of the fixing roller 120 and the axis S of the pressure roller 130. Nevertheless, in other embodiments, for example, the heating device 110, the fixing roller 120, and the pressure roller 130 may be disposed one above another such that the middle point T of the heat transfer portion HT is not located on the line L1 that perpendicularly intersects each of the axis Q of the fixing roller 120 and the axis S of the pressure roller 130.

Figures 7A, 7B:
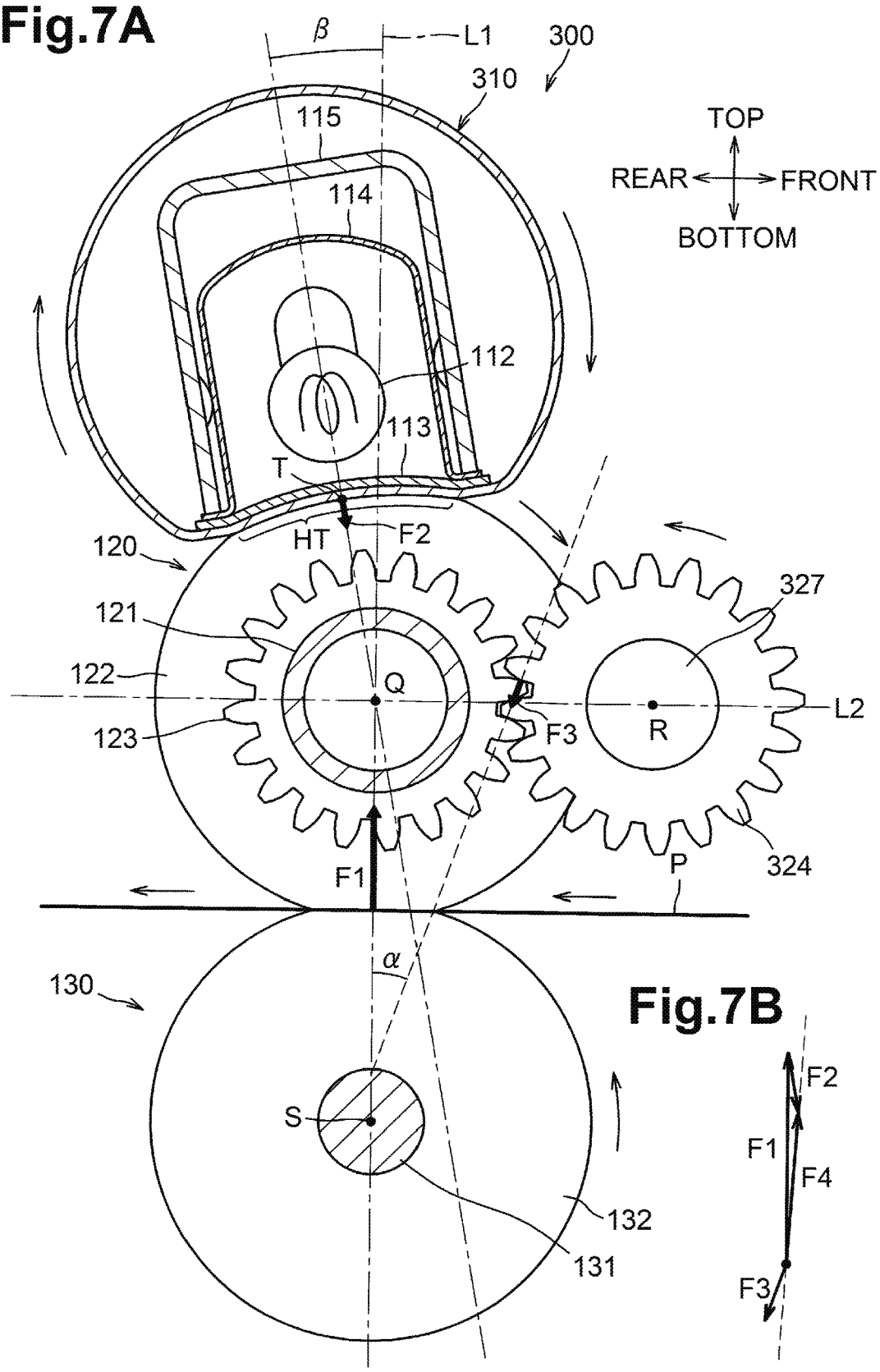
FIG. 7A is a cross sectional view of a fixing device in another alternative embodiment according to one or more aspects of the disclosure.
FIG. 7B is a diagram illustrating pressing forces acting on respective corresponding components in the fixing device in the another alternative embodiment according to one or more aspects of the disclosure.

In another alternative embodiment, as illustrated in FIG. 7A, for example, in a fixing device 300, a middle point T of a heat transfer portion HT of a heating device 310 is located further to the rear than the line L1 that perpendicularly intersects each of the axis Q of the fixing roller 120 and the axis S of the pressure roller 130 (e.g., downstream from the line L1 in the sheet conveying direction). In this case, the second pressing force F2 pressing the heating device 310 toward the fixing roller 120 is directed downward and is angled toward the rear from the line L1 by an angle β. The fixing device 300 includes a drive gear 324 instead of the drive gear 124. The drive gear 324 is disposed further to the front than the driven gear 123 (e.g., upstream from the driven gear 123 in the sheet conveyance direction). An axis R of the drive gear 324 is located on the line L2.

As illustrated in FIG. 7B, in the fixing device 300, the first pressing force F1 has a greater magnitude than the second pressing force F2. Therefore, a resultant force F4 of the first pressing force F1 and the second pressing force F2 is directed upwardly frontward. A third pressing force F3 is directed downwardly rearward (e.g., toward downstream in the sheet conveyance direction). More specifically, for example, the third pressing force F3 is angled by an angle α (which is the same degrees as the pressure angle of the driven gear 123 and the drive gear 324) from the line L1. Therefore, the third pressing force F3 includes a component opposite in direction to the resultant force F4 of the first pressing force F1 and the second pressing force F2. Accordingly, when a driving force is inputted to the fixing roller 120, some of the resultant force F4 may be cancelled by the third pressing force F3. Accordingly, a load (e.g., the resultant force F4) that acts on the first bearings 125 for the fixing roller 120 may be reduced. The first pressing force F1 has a greater magnitude than a resultant force of the second pressing force F2 and a component of the third pressing force F3 directed parallel to the second pressing force F2. Therefore, in both cases whether or not the fixing roller 120 is being applied with a driving force from the drive gear 324, the roller shaft 121 of the fixing roller 120 is pressed upward against the first bearings 125, and a direction that the load acts on the first bearings 125 does not change significantly between those cases.

In the illustrative embodiment (refer to FIG. 4) and the alternative embodiments (refer to FIGS. 6, 7A, and 7B), the shaft 121 of the fixing roller 120 is a hollow cylindrical rod. Nevertheless, in other embodiments, for example, the shaft 121 of the fixing roller 120 may be a solid cylindrical rod.

In the illustrative embodiment (refer to FIG. 4) and the alternative embodiments (refer to FIGS. 6, 7A, and 7B), the shaft 131 of the pressure roller 130 is a solid cylindrical rod. Nevertheless, in other embodiments, for example, the shaft 131 of the pressure roller 130 may be a hollow cylindrical rod.

In the illustrative embodiment (refer to FIG. 4) and the alternative embodiments (refer to FIGS. 6, 7A, and 7B), the first bearings 125 for the fixing roller 120 support the outer circumferential surface of the shaft 121 of the fixing roller 120. Nevertheless, in other embodiments, for example, the first bearings 125 for the fixing roller 120 may support an inner circumferential surface of the shaft 121 of the fixing roller 120.

In the illustrative embodiment (refer to FIG. 4) and the alternative embodiments (refer to FIGS. 6, 7A, and 7B), the stay covers 116 for covering the stay 115 are provided. Nevertheless, in other embodiments, for example, such stay covers might not necessarily be required. If no stay cover is provided, the upper arms 150 may press the stay 115 directly to press the heating device 110 against the fixing roller 120.

In the illustrative embodiment (refer to FIG. 4) and the alternative embodiments (refer to FIGS. 6, 7A, and 7B), the driven gear 123 is disposed at the left end portion of the shaft 121 of the fixing roller 120. Nevertheless, in other embodiments, for example, the driven gear 123 may be disposed at the right end portion of the shaft 121 of the fixing roller 120. Further, the driven gear 123 may be disposed at each end portion of the shaft 121 of the fixing roller 120.

In the illustrative embodiment (refer to FIG. 4) and the alternative embodiments (refer to FIGS. 6, 7A, and 7B), the disclosure has been applied to the color printer 1. Nevertheless, in other embodiments, for example, the disclosure may be applied to other image forming apparatuses, such as monochrome printers, copying machines, and multifunction devices.

In the illustrative embodiment (refer to FIG. 4) and the alternative embodiments (refer to FIGS. 6, 7A, and 7B), the heating device 110 includes a belt-shaped rotary member (e.g., the endless belt 111). Nevertheless, in other embodiments, for example, the heating device may include, for example, a heating roller.

In the illustrative embodiment (refer to FIG. 4) and the alternative embodiments (refer to FIGS. 6, 7A, and 7B), a roller (e.g., the pressure roller 130) is used as the pressure member. Nevertheless, in other embodiments, for example, the pressure member may be, for example, a belt-shaped rotary member.

In the illustrative embodiment (refer to FIG. 4) and the alternative embodiments (refer to FIGS. 6, 7A, and 7B), the halogen lamp 112 is used as a heater. Nevertheless, in other embodiments, for example, the heater may be a resistance heater or an induction heater.

The one or more aspects of the disclosure may be implemented in various combinations of the elements described in the illustrative embodiments and alternative embodiments.

What is claimed is:

1. A fixing device for thermally fixing a developer image transferred to a recording medium thereon, comprising:

a fixing roller;

a pressure member contacting a portion of the fixing roller and configured to nip the recording medium in cooperation with the fixing roller;

a heating device disposed opposite to the pressure member relative to the fixing roller, the heating device contacting another portion of the fixing roller, the heating device being configured to heat the fixing roller;

a first pressing member configured to press the pressure member toward the fixing roller with a first pressing force;

a second pressing member configured to press the heating device toward the fixing roller with a second pressing force; and a pair of bearings supporting end portions of the fixing roller such that the fixing roller is rotatable, wherein the fixing roller includes a driven gear to be driven by a drive gear that is configured to apply a third pressing force to the driven gear, and wherein the third pressing force includes a component opposite in direction to a resultant force of the first pressing force and the second pressing force.

2. The fixing device according to claim 1, wherein the first pressing force has a greater magnitude than the second pressing force.

3. The fixing device according to claim 2, wherein the first pressing force has a greater magnitude than a resultant force of the second pressing force and a component of the third pressing force directed parallel to the second pressing force.

4. The fixing device according to claim 1, wherein the fixing roller, the pressure member, and the heating device are disposed one above another.

5. The fixing device according to claim 1, wherein the third pressing force is parallel to one of the first pressing force and the second pressing force, the one of the first pressing force and the second pressing force having a greater magnitude than the other of the first pressing force and the second pressing force.

6. The fixing device according to claim 1, wherein the first pressing member is disposed corresponding to each end portion of the pressure member and is configured to press the each end portion of the pressure member with the first pressing force, and wherein the second pressing member is disposed corresponding to each end portion of the heating device and is configured to press the each end portion of the heating device with the second pressing force.

7. The fixing device according to claim 1, wherein the fixing roller further includes:

a shaft supported by the bearings; and a roller body contactable to the recording medium, and wherein the shaft of the fixing roller is a hollow cylindrical metal rod.

8. The fixing device according to claim 7, wherein the roller body includes an elastic layer covering a circumferential surface of the shaft.

9. The fixing device according to claim 7, wherein the bearings support the shaft of the fixing roller.

10. The fixing device according to claim 1, wherein the heating device includes:

a nip member; and a belt sandwiched between the nip member and the fixing roller and configured to rotate while being sandwiched therebetween.

11. The fixing device according to claim 10, wherein the heating device includes a heater configured to heat the nip member.

12. The fixing device according to claim 1, wherein the pressure member includes:

a shaft that is a solid cylindrical metal rod and is configured to be pressed by the first pressing member; and a roller body including an elastic layer covering a circumferential surface of the shaft of the pressure member and being contactable to the recording medium.

13. The fixing device according to claim 1, wherein the drive gear and the driven gear are supported by a gear plate that defines a distance between an axis of the drive gear and an axis of the driven gear.

* * * * *